US009273497B2

(12) United States Patent
Torka et al.

(10) Patent No.: US 9,273,497 B2
(45) Date of Patent: Mar. 1, 2016

(54) MOTOR VEHICLE DOOR LATCH

(75) Inventors: Artur Torka, Hattingen (DE); Udo Orzech, Velbert (DE)

(73) Assignee: Huf Huelsbeck & Fuerst GmbH & Co. KG, Velbert (DE)

( * ) Notice: Subject to any disclaimer, the term of this patent is extended or adjusted under 35 U.S.C. 154(b) by 565 days.

(21) Appl. No.: 13/600,694

(22) Filed: Aug. 31, 2012

(65) Prior Publication Data

US 2013/0076045 A1 Mar. 28, 2013

(30) Foreign Application Priority Data

Sep. 23, 2011 (DE) ..... 10 2011 053 901
Mar. 29, 2012 (DE) ..... 10 2012 102 723

(51) Int. Cl.

| | |
|---|---|
| ***E05C 3/06*** | (2006.01) |
| ***E05B 77/36*** | (2014.01) |
| ***E05B 83/18*** | (2014.01) |
| ***E05B 81/14*** | (2014.01) |
| ***E05B 81/20*** | (2014.01) |
| *E05C 3/00* | (2006.01) |
| *E05B 81/00* | (2014.01) |

(52) U.S. Cl.

CPC ..... *E05B 77/36* (2013.01); *E05B 81/14* (2013.01); *E05B 81/20* (2013.01); *E05B 83/18* (2013.01); *E05B 81/00* (2013.01); *Y10T 292/0945* (2015.04)

(58) Field of Classification Search

CPC ..... E05B 81/00; E05B 81/04; E05B 81/06; E05B 81/14; E05B 81/18
USPC ..... 292/201, 216
See application file for complete search history.

(56) References Cited

U.S. PATENT DOCUMENTS

| | | | | | |
|---|---|---|---|---|---|
| 2,881,021 | A | * | 4/1959 | Jacobson | 292/229 |
| 3,378,291 | A | | 4/1968 | Brian | |
| 3,386,761 | A | * | 6/1968 | Johnstone et al. | 292/201 |
| 3,504,511 | A | * | 4/1970 | Allen | 70/241 |
| 3,566,703 | A | * | 3/1971 | Van Noord | B62D 1/181 180/286 |
| 3,695,662 | A | * | 10/1972 | Ploughman | 292/216 |
| 4,322,959 | A | * | 4/1982 | Mochida | 70/241 |

(Continued)

FOREIGN PATENT DOCUMENTS

| | | | | |
|---|---|---|---|---|
| DE | 3725075 | C1 | 8/1988 | |
| DE | 19614123 | A1 * | 10/1997 | E05B 81/14 |

(Continued)

OTHER PUBLICATIONS

European Search Report of Corresponding European Application No. 2 573 300 dated Jan. 8, 2014, 3 pages.

*Primary Examiner* — Carlos Lugo
(74) *Attorney, Agent, or Firm* — Fay Sharpe LLP

(57) ABSTRACT

A motor vehicle door latch includes a rotary latch which encompasses a closing element when in the closed position, and is preloaded toward an open position of the closing element. A safety catch is engaged with the rotary latch so that the rotary latch is prevented from moving toward the open position. A coupling section of the safety catch is dynamically coupled with a drive element and moves the safety catch between the engagement position and a releasing position so that the rotary latch can move toward the open position. The opening sound is reduced to a minimum. The drive element moves the safety catch from the engagement position toward the releasing position so that the rotary latch, which is still engaged with the safety catch during such movement, moves toward the open position.

12 Claims, 5 Drawing Sheets

(56) References Cited

U.S. PATENT DOCUMENTS

| | | | | | |
|---|---|---|---|---|---|
| 4,342,209 | A * | 8/1982 | Kleefeldt | 70/264 | |
| 4,364,249 | A * | 12/1982 | Kleefeldt | 70/264 | |
| 4,395,064 | A * | 7/1983 | Bellot et al. | 292/201 | |
| 4,440,006 | A * | 4/1984 | Kleefeldt | 70/264 | |
| 4,518,180 | A * | 5/1985 | Kleefeldt | E05B 81/06 | 292/201 |
| 4,691,949 | A * | 9/1987 | Grantz et al. | 292/216 | |
| 4,892,339 | A * | 1/1990 | Kleefeldt | E05B 81/20 | 292/201 |
| 4,948,184 | A * | 8/1990 | Weyerstall et al. | 292/216 | |
| 4,974,885 | A * | 12/1990 | Yokoyama | 292/201 | |
| 4,976,477 | A * | 12/1990 | Nakao | 292/201 | |
| 4,978,153 | A * | 12/1990 | Hirsch et al. | 292/201 | |
| 4,979,384 | A * | 12/1990 | Malesko et al. | 70/241 | |
| 5,180,198 | A * | 1/1993 | Nakamura et al. | 292/201 | |
| 5,423,582 | A * | 6/1995 | Kleefeldt | E05B 81/20 | 292/201 |
| 5,516,164 | A * | 5/1996 | Kobayashi | 292/201 | |
| 5,613,716 | A * | 3/1997 | Cafferty | 292/216 | |
| 6,065,316 | A * | 5/2000 | Sato et al. | 70/264 | |
| 6,079,237 | A * | 6/2000 | Hochart | 70/278.6 | |
| 6,158,788 | A * | 12/2000 | Ikeda et al. | 292/216 | |
| 6,279,972 | B1 * | 8/2001 | Brill et al. | 292/216 | |
| 6,378,920 | B1 * | 4/2002 | Ostrowski et al. | 292/216 | |
| 6,499,776 | B2 * | 12/2002 | Takamura | 292/201 | |
| 6,948,745 | B2 * | 9/2005 | Chevalier | 292/201 | |
| 7,341,290 | B2 * | 3/2008 | Torka | E05B 81/20 | 292/201 |
| 7,770,946 | B2 * | 8/2010 | Kouzuma | 292/201 | |
| 2004/0094971 | A1 * | 5/2004 | Warmke et al. | 292/201 | |
| 2005/0212302 | A1 * | 9/2005 | Fisher | 292/216 | |
| 2006/0001275 | A1 * | 1/2006 | Plett et al. | 292/216 | |
| 2015/0061301 | A1 * | 3/2015 | Torka | E05B 77/36 | 292/194 |

FOREIGN PATENT DOCUMENTS

| | | | | |
|---|---|---|---|---|
| DE | 10214691 | A1 * | 10/2003 | E05B 85/26 |
| DE | 102005048564 | A1 * | 4/2007 | E05B 81/14 |
| DE | 2573301 | A2 * | 3/2013 | E05B 77/42 |
| DE | WO 2015090745 | A1 * | 6/2015 | E05B 81/14 |
| EP | 0393595 | A2 | 10/1990 | |
| EP | 0397966 | A1 | 11/1990 | |
| EP | 0978609 | A1 | 2/2000 | |
| EP | 1970508 | A2 | 9/2008 | |
| FR | 2775717 | A1 * | 9/1999 | E05B 79/12 |
| FR | 2927109 | A1 * | 8/2009 | E05B 77/02 |

* cited by examiner

MOTOR VEHICLE DOOR LATCH

SUMMARY

The invention relates to a motor vehicle door latch including a rotary latch, which encompasses a closing element when in the closed position, and is preloaded toward one of the releasing open positions of the closing element, a safety catch, which is engaged with the rotary latch in an engagement position in such a manner that the rotary latch is prevented from moving toward the open position, and a drive element, with which is dynamically coupled a coupling section of the safety catch, and which moves the safety catch between the engagement position and a releasing position, in which the safety catch is not engaged with the rotary latch, such that the rotary latch can move toward the open position.

Furthermore, the present invention concerns a method for opening a motor vehicle door latch, having a rotary latch, which encompasses a closing element when in the closed position, and is preloaded toward one of the releasing open positions of the closing element, a safety catch, which is engaged with the rotary latch in an engagement position in such a manner that the rotary latch is prevented from moving toward the open position, and a drive element, with which a coupling section of the safety catch is dynamically coupled, and which moves the safety catch between the engagement position and a releasing position, in which the safety catch is not engaged with the rotary latch, such that the rotary latch can move toward the open position, wherein the safety catch and the rotary latch are disengaged for the purpose of opening, in that the safety catch, at least in part, is pivoted away from the rotary latch.

A motor vehicle door latch of the type specified above is used, for example, in a hatchback of a motor vehicle, and comprises a closing element connected to a trunk lid, usually designed as a rotary latch, and a lock counterpart connected to a body part of the vehicle, which can be designed in the form of a retention bar or locking bolt. In order to open the hatchback, a user actuates (e.g. by means of an electronic key) a control device, by means of which the hatchback, via a drive element, which is preferably operated by means of an electromotor, can be opened. For this, a pivotally supported safety catch is pivoted away from an engagement position in which the safety catch is engaged with the rotary latch, toward a releasing position to the point where it has reached the released position, and is no longer engaged with the rotary latch, as a result of which, a rotational motion releases the rotary latch from the closed position toward an open position.

When the hatchback is in the closed position, said hatchback is preloaded against a sealing gasket. Preloaded is understood hereby to mean that the sealing counter pressure caused by a hatchback sealing gasket acts against the closing of the motor vehicle hatchback. As a result, a high pressure acts in the opening direction of the hatchback due to the compression of the sealing gasket by the hatchback. When the safety catch is no longer engaged with the rotary latch, the pressure built up by the sealing gasket is quickly released in the form of a so-called discharge stroke, and the hatchback moves in the opening direction in an abrupt and sudden manner, which becomes apparent in a negative manner through an acoustically audible opening sound, leading to a certain discomfort.

The invention assumes the objective of creating a solution which provides for the manufacture of a motor vehicle door latch in a structurally simple manner, and cost-effectively, with which the opening sound is reduced to a minimum, which is at least not significantly audible during the opening procedure, and does not generate a sound that has discomforting effect on of the user.

With a motor vehicle door latch of the type specified above, the objective is obtained according to the invention in that of the safety catch is moved by the drive element during the movement away from the engagement position toward the release position in such a manner that the rotary latch, which is still engaged with the safety catch during said movement, is moved toward the open position.

Likewise, the objective is attained with a method of the type specified above, according to the invention, in that the safety catch is moved by the drive element during the movement away the engagement position toward the release position in such a manner that the rotary latch, which is still engaged with the safety catch during said movement, is moved toward the open position.

For this, the movement of the rotary latch can be a rotation, both with the motor vehicle door latch according to the invention, as well as with the method according to the invention.

Advantageous and useful configurations and further embodiments of the invention arise from the dependent Claims.

A motor vehicle door latch and a method for opening a motor vehicle door latch are made available by the invention, which contribute to improving the performance and quality of the latch and its functionality. The motor vehicle door latch according to the invention is distinguished by a functional construction, and features a simple and cost-effective design. The safety catch and the rotary latch remain engaged during the movement procedure of the safety catch toward the release position by means of the triggering mechanism according to the present invention. In fact, it is not the case that this movement of the safety catch enables the opening of the hatchback. However, by means of this (first or initial) movement during the opening procedure, the preloading of the hatchback is reduced, because the defined movement of the safety catch causes a relative movement between the motor vehicle door latch and the closing element, and therefore a release of the tension exerted on the hatchback, wherein the rotary latch is rotated through a predetermined rotation to the open position. As a result, the hatchback is ultimately allowed to move about a defined lift in relation to the closing element, as a result of which the preloading and the pressure is removed, which, with the motor vehicle door latch known previously, in the prior art, was responsible for the acoustically noticeable and disturbing opening sound. Accordingly, the invention provides that the preloading between the hatchback, or motor vehicle door latch, respectively, and the closing element, is reduced, before the safety catch and the rotary latch are disengaged.

In the design of the motor vehicle door latch, as well as the method, the invention provides that the movement of the drive element is a rotational movement, which causes a substantially tangential movement of the safety catch with respect to the rotary latch during the movement of the safety catch from the engaged position toward the release position, and then, in order to disengage the safety catch from the rotary latch, causes a substantially radial movement of the safety catch away from the rotary latch. This movement correlates to a locking section of the safety catch, which is engaged when said safety catch is in the engaged position with respect to the rotary latch. In other words, the drive element for opening the motor vehicle door latch is rotated such that the safety catch, or at least a section of the safety catch, i.e. the locking section, is first moved in a substantially tangential manner with respect to the rotary latch during the movement from the engaged position toward the release position, and then, in order to disengage the safety catch from the rotary latch, is moved away from the rotary latch in a substantially radial path. The movement carried out during the opening procedure of the motor vehicle door latch of the safety catch is thus a two-part movement, or, respectively, consists of a movement sequence, wherein the safety catch is moved in at least two different spatial paths. In order to first eliminate the pressure of the hatchback when it is in the closed position, or respectively, to release the preloaded hatchback, a substantially tangential movement of the safety catch with respect to the rotary latch is carried out. During this movement, the safety catch remains engaged with the rotary latch, whereby, depending on the tangential distance, about which the safety catch is moved, the rotary latch is allowed to rotate to the open position, by means of which the pressure of the hatchback is reduced. Only after the pressure reduction, or respectively, the reduction of the preloading, does the disengagement with the rotary latch occur through the radial lateral movement of the safety catch, by means of which this then releases the closing element for the opening of the hatchback. The opening movement of the safety catch, composed of two movements in different spatial directions, enables thereby the reduction of the preloading, which acts on the hatchback when it is in the closed position, in that the safety catch causes a controlled movement of the hatchback in the opening direction for a certain lift.

For the design of a motor vehicle door latch that is particularly compact and requires a limited installation space, it is advantageous for the rotary latch to be rotatably mounted by means of a rotational axle, having a fixed position, disposed on the housing of the motor vehicle door latch. Moreover, it is advantageous thereby if the coupling section of the safety catch, coupled in a dynamic manner to the drive element, is attached to a connecting element, and can be pivoted about said connecting element.

To reduce the opening sound by reducing the preloading between the hatchback, or respectively, the motor vehicle door latch, and the closing element, before the safety catch and the rotary latch are disengaged, it is provided in further designs of the invention that the connecting element defines a joint for the safety catch, wherein the joint moves in a translational manner toward the release position in relation to the rotational axle of the rotary latch. With the movement of the joint toward the rotational axle, although the safety catch is still engaged with the rotary latch, the rotary latch can, however, move toward its open position due to the translational and tangential movement of the safety catch in relation to the rotary latch.

In other embodiments, the invention provides that the drive element is mounted, such that it can rotate about a rotational axle, on a housing element of the motor vehicle door latch.

It is of particular advantage thereby if the connecting element, or respectively, the joint, is disposed on the drive element, radially offset in relation to the rotational axle. In this manner is it possible for the safety catch to rotate together with the drive element when the drive element is rotated, whereby the safety catch however, is not static, but rather, is attached to the drive element in a pivotal manner, such that the drive movement of the drive element causes a pivoting and/or, if applicable, a translational movement of the safety catch. A rotation of the drive element can, in this manner, cause a substantially translational movement of the safety catch in a simple manner, in the same manner as a simple bent lever.

A particularly powerful, and at the same time, efficient type of dynamic coupling of the drive element and the coupling section of the safety catch can be obtained by means of a type of doubled bent lever. For this purpose, the invention provides, in its design, for the provision of a push rod, a first end of which is pivotally, and radially offset to the rotational axle, coupled to the drive element, and a second end of which accommodates the connecting element dynamically coupled to the coupling section of the safety catch, wherein a first end of an articulated lever is supported at a fixed location, in such a manner that it can rotate on a guide axle attached to the housing element, and a second end of the articulated lever supports the push rod and the connecting element, coupled to the safety catch such that it can move in a rotatable and pivotal manner. In this manner, a first bent lever is defined by the second end of the push rod and the articulated lever supported at a fixed location, wherein the safety catch is coupled via the connecting element to the articulated lever and to the push rod. A second bent lever is defined therein by the first end of the push rod and its, in relation to the rotational axle, eccentric, or respectively, radially offset coupling to the drive element.

To increase safety, in the case of a motor vehicle accident, in which acceleration forces act on the motor vehicle door latch, and can lead therefore to the safety catch and/or rotary latch becoming released in such a manner that they become disengaged in an undesired manner, it is provided according to the invention that the safety catch have a bend which abuts the guide axle, acting as a limit stop, and restricting the movement of the safety latch beyond the engagement position, when in the engaged position. In this position, in which the bend of the safety catch abuts the guide axle, i.e. in the engaged position, the push rod, or respectively, its force line, assumes a position in which it has exceeded a dead point, and thereby becomes locked in a self-retaining manner, wherein the guide axle functions as a mechanical stop.

In order that the preloading, moreover, in which the hatchback is preloaded in the closed position, is gradually and not abruptly reduced, it is furthermore advantageous in the design of the invention, if the movement from the engaged position toward the release position of the coupling section of the safety catch, attached in a pivotal manner to the connecting element, is a movement having a circular arc section shape. Movements having a quarter circle arc shape, or even a semicircle arc shape, are conceivable.

A structurally particularly simple possibility for the defined guidance of the safety catch to the release position consists, in another design of the motor vehicle door latch according to the invention, of the locking section of the safety catch, engaged with the rotary latch when in the engaged position, being guided in terms of its movement by means of a guide element and/or a control pin attached to the safety catch. With this guided movement, the safety catch is moved radially away from the rotary latch during the opening procedure, wherein it is of particular advantage when only the section of the safety catch engaged with the rotary latch, and not he entire safety catch, is moved away from the rotary latch.

It is furthermore provided in the design of the motor vehicle door latch, that the guide element is pivotally disposed on a housing element of the motor vehicle door latch, and having a guidance receptor that results in a movement of the locking section of the safety catch that can be brought into engagement with the rotary latch, to the rotary latch, or away from the rotary latch. Alternatively, the guide element could also be formed on the rotary latch itself, and ensure that the locking section of the safety catch is disengaged from the rotary latch.

Finally, in one design of the motor vehicle door latch according to the invention, it is provided that the safety catch is preloaded toward the engagement position. In this manner, the safety catch is permanently pushed toward the engagement position, which can be achieved, for example, by means of at least one spring element, which can be designed as a tension or pressure spring. For this it is sufficient if solely the section of the safety catch that can be engaged with the rotary latch, or respectively, the section that is engaged with the rotary latch, is preloaded.

It is understood that the characteristics specified above, and to be elaborated on below, not only in the respective given combinations, but also in other combinations, or in and of themselves, can be implemented, without abandoning the framework of the present invention. The framework of the invention is only defined by the Claims.

BRIEF DESCRIPTION OF THE DRAWINGS

Further details, characteristics and advantages of the subject matter of the invention can be derived from the following description in the context of the drawings, in which a preferred embodiment example of the invention is depicted in an exemplary manner. The drawings show.

DETAILED DESCRIPTION

FIGS. 1-13 show schematically, in various views, only the elements substantial to the invention of a motor vehicle door latch 1, in particular a hatchback lock assembly, wherein the FIGS. 1-8 depict a first embodiment, and the FIGS. 9-13 depict a second embodiment of the motor vehicle door latch 1 according to the invention.

Figure 1:
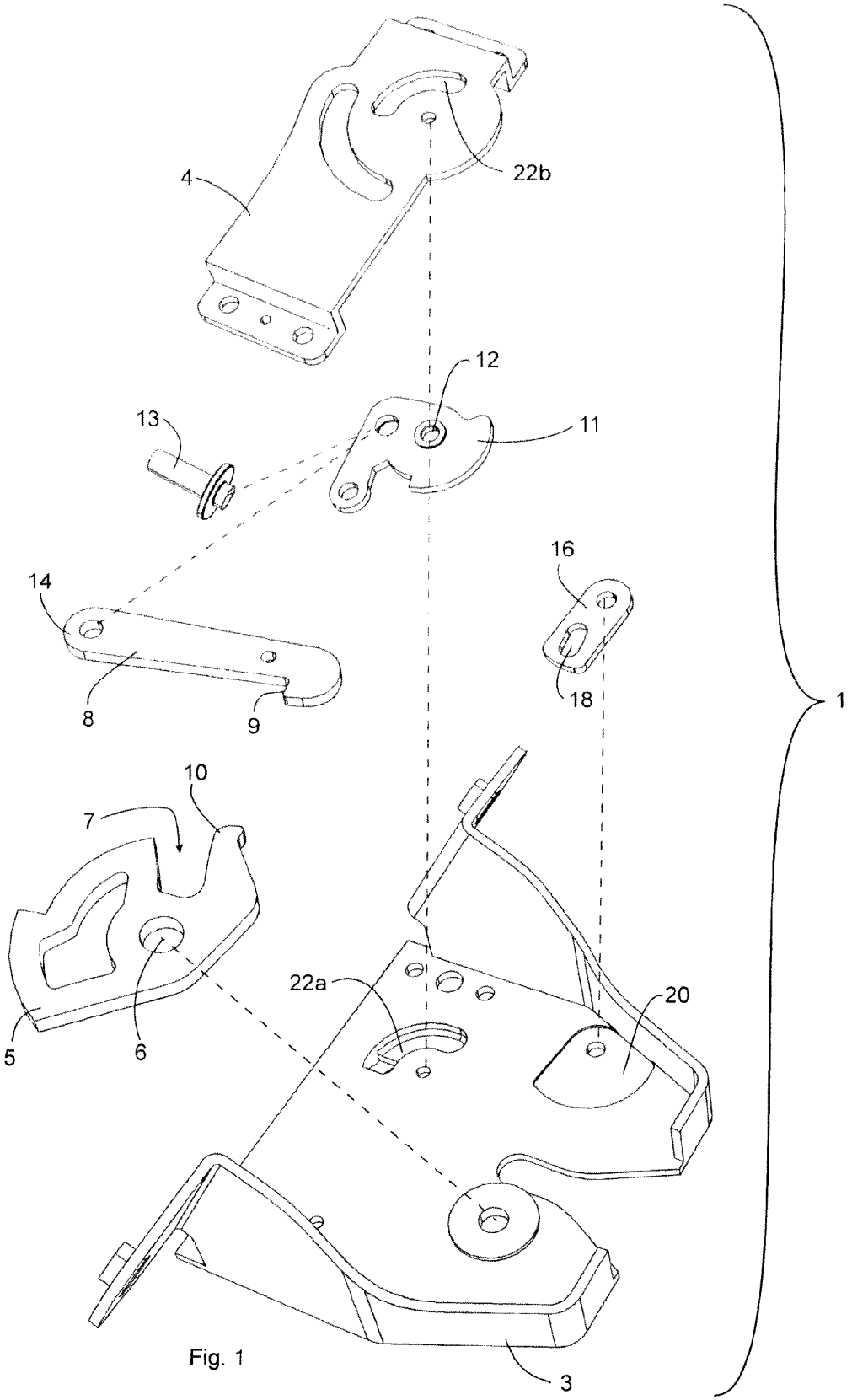
FIG. 1: a motor vehicle door latch according to the invention in accordance with a first embodiment in a perspective, individual parts depiction.
Figure 2:
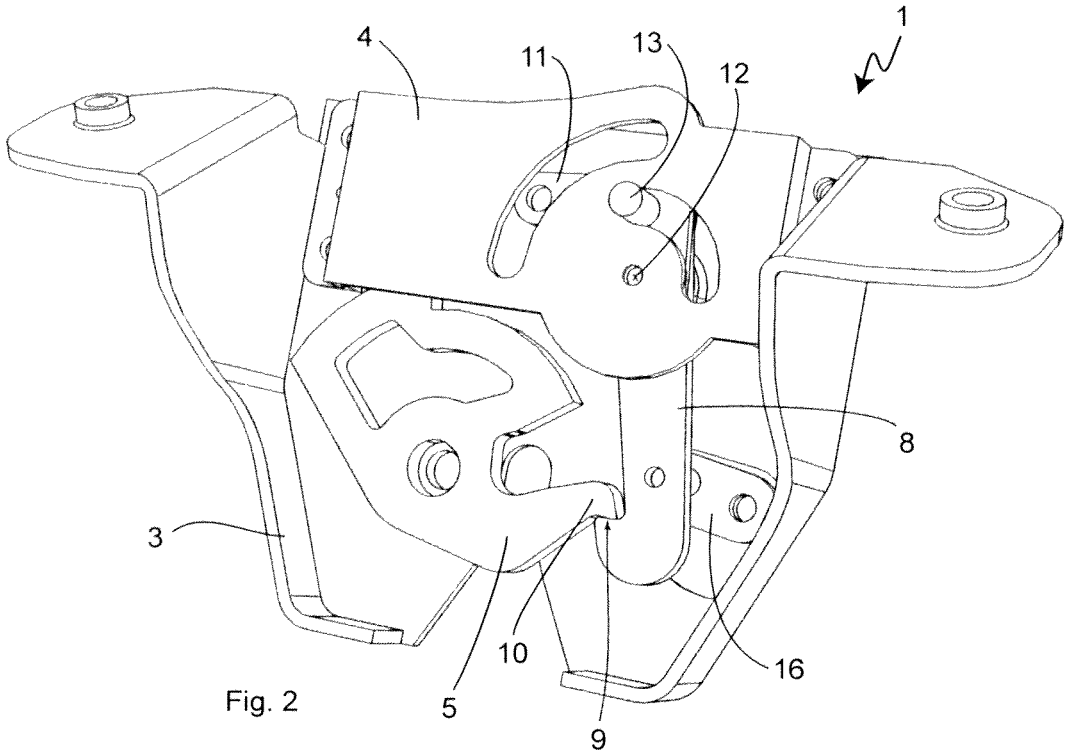
FIG. 2: a motor vehicle door latch from FIG. 1, in the assembled state, from a perspective view.
Figure 3:
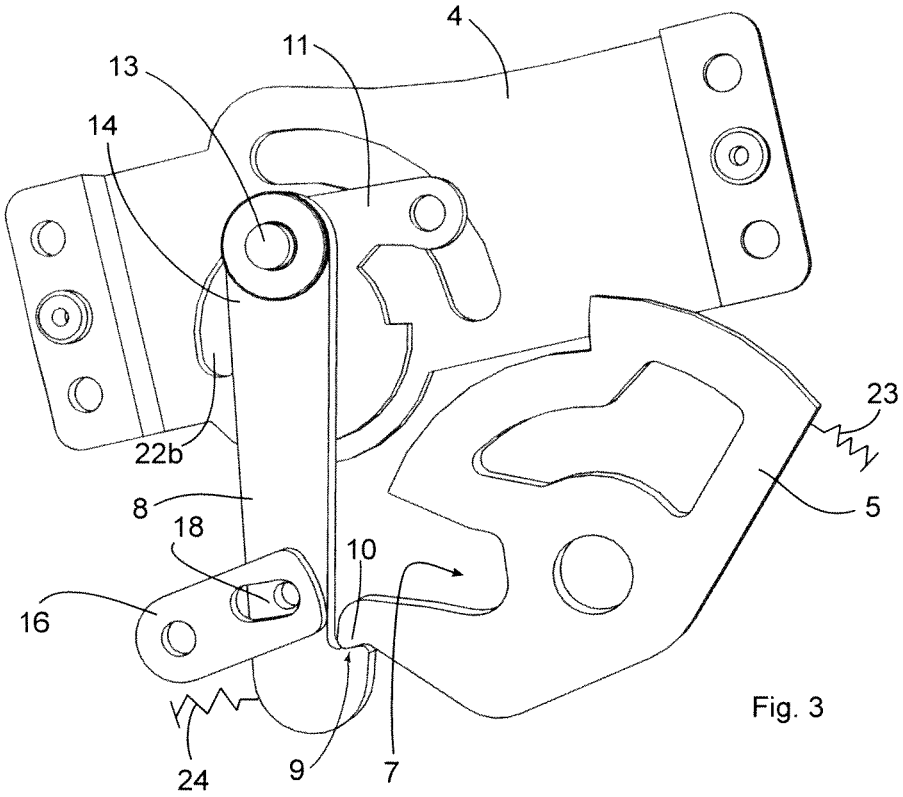
FIG. 3: a perspective rear view of the motor vehicle door latch depicted in FIG. 2, FIG. 4: the motor vehicle door latch according to the first embodiment in a closed position.
Figure 6:
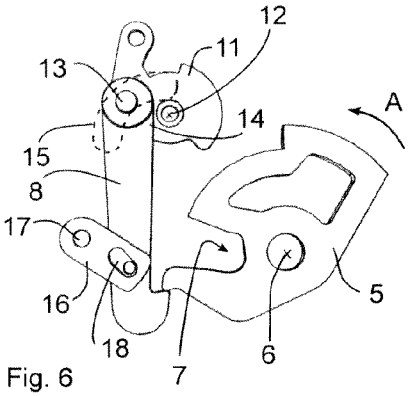
FIG. 6: the motor vehicle door latch according to the first embodiment in another intermediate position between the closed and the open positions.
Figure 7:
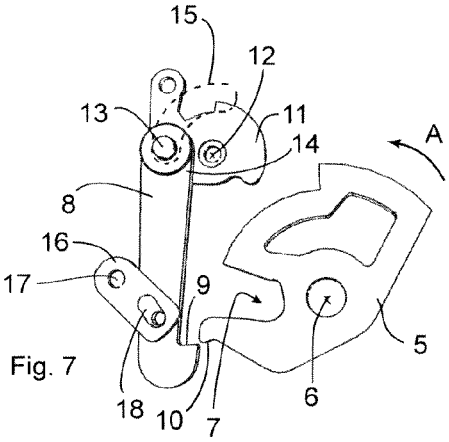
FIG. 7: the motor vehicle door latch according to the first embodiment in an open position.
Figure 8:
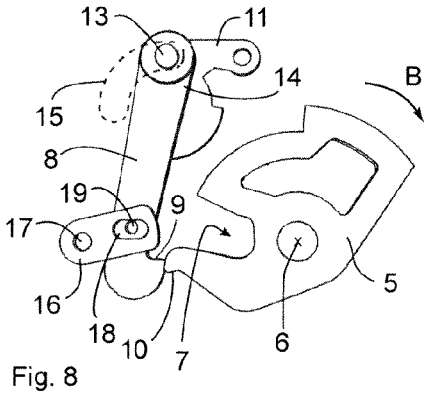
FIG. 8: the motor vehicle door latch according to the first embodiment during the closing procedure in a position shortly before reaching the closed position.

While the motor vehicle door latch 1 according to the first embodiment is depicted in FIG. 1 in an individual parts depiction, FIGS. 2-8 show the assembled motor vehicle door latch 1. FIGS. 4-7 show therein various positions of the components of the motor vehicle door latch 1 during the opening procedure, while in contrast, FIG. 8 shows a position during the closing procedure.

Figure 4:
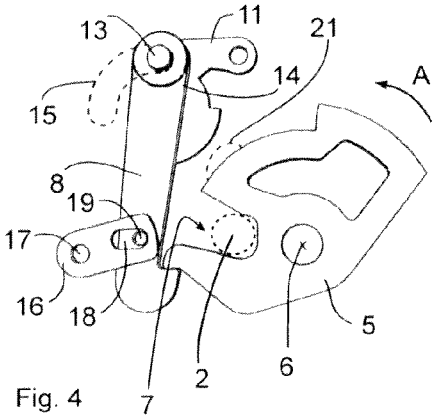
Figure 9:
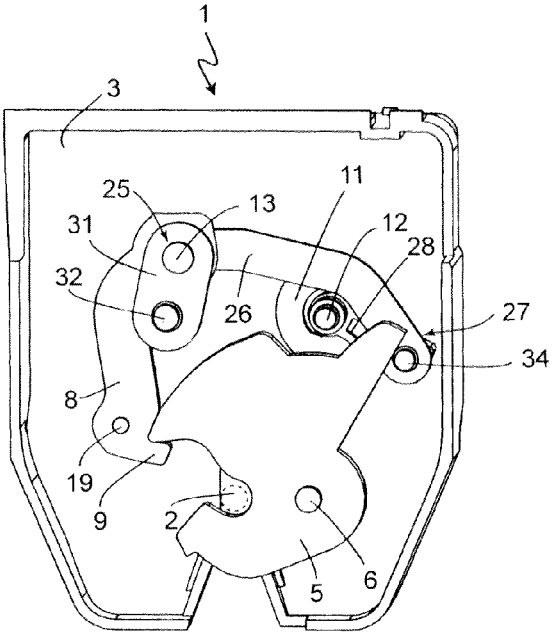
FIG. 9: a motor vehicle door latch according to the invention, in accordance with a second embodiment from a front view.
Figure 10:
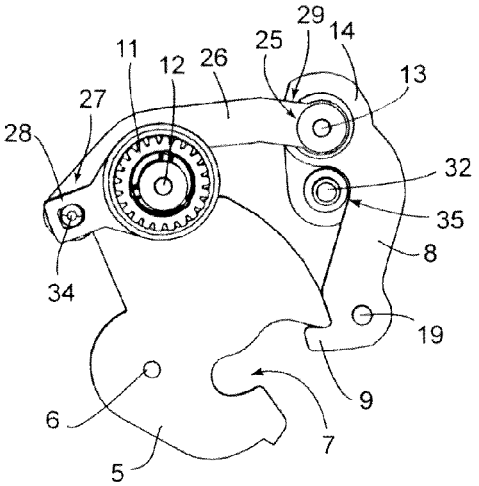
FIG. 10: the motor vehicle door latch from FIG. 9 in a rear view.
Figure 12:
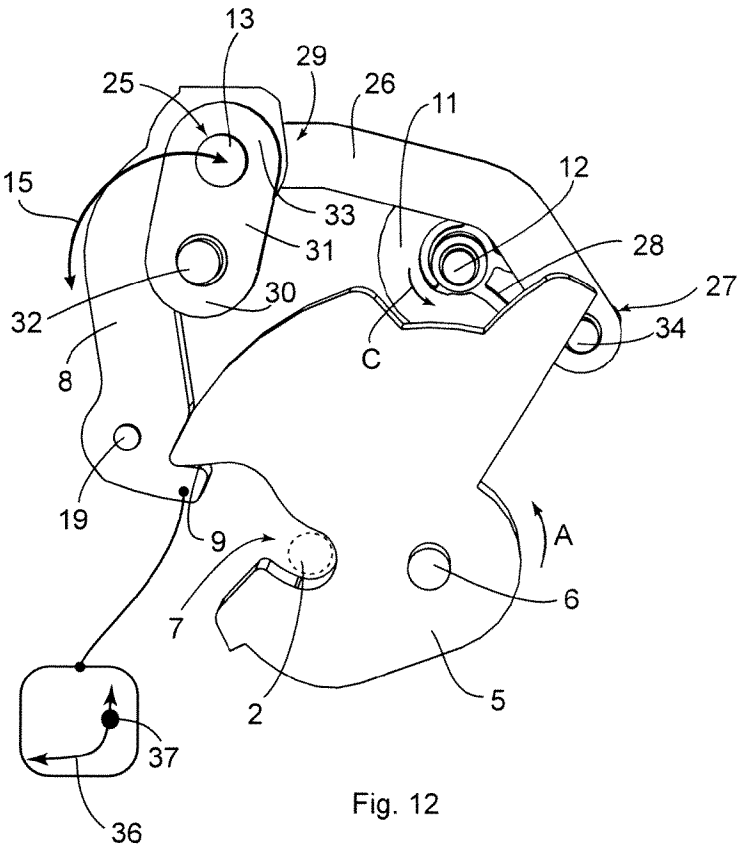
FIG. 12: the motor vehicle door latch from FIG. 10 in the engaged position, or respectively, the closed position.

The motor vehicle door latch 1 mounted on a hatchback of a motor vehicle engages with a closing element 2 for the purpose of closing said latch, depicted schematically, and depicted in FIGS. 4, 9, and 12, solely through broken lines. The closing element 2 can, for example, be designed as a locking bolt or a retention bar, and is attached to a motor vehicle frame. The motor vehicle door latch 1 depicted in FIG. 1 in an individual parts depiction according to the first embodiment, comprises housing elements 3 and 4 that can be connected to one another, a rotary latch 5, rotatably mounted on a rotational axle 6 on the housing element 2, and a rotary latch jaw 7, in which the closing element 2 engages. The rotary latch 5 is preloaded by means of a spring element 23, only schematically indicated in FIG. 3, in such a manner that it is tensioned, such that, with the views shown in FIGS. 4-7, it will turn in a counterclockwise (arrow A) direction, such that the closing element 2 will be released (downward, in FIGS. 4-7). In order to prevent releasing in the closed state shown in FIG. 4, the rotary latch 5 is retained by a safety catch 8, in that a locking section 9 of the safety catch 8 is engaged with a locking arm 10 on the rotary latch jaw 7. The position shown in FIG. 4 is the so-called closed position, in which the rotary latch 5 is in a closed position, and the safety catch 8 is in an engaged position. By means of the preloading spring force exerted on the safety catch 5, the rotary latch 5 pushes against the locking section 9 of the safety catch 8 with its locking arm 10 when in the closed position, by means of which the closing element 2 is immobilized in the rotary latch jaw 7, as can be seen in FIG. 4. In other words, the rotary latch 5 is preloaded toward a releasing open position of the closing element 2. In the engaged position, the safety catch 8 is therefore engaged with the rotary catch 5 in such a manner that the rotary catch 5 is prevented from moving toward the open position.

The safety catch 8 is connected to a drive element 11 such that it is coupled in a movable manner. The drive element 11 is mounted on the housing element 4 about a rotational axle 12. A bolt shaped connecting element 13 is attached to the drive element 11, which is designed in part to be disk shaped, which connecting element is radially offset to the rotational axle 12 disposed on the drive element 11, and attached thereto. The connecting element 13 connects the drive element 11 to a coupling section 14 of the safety catch 8, such that the drive element 11 moves the safety catch 8 between the engaged position and a released position, in which the safety catch 8 is disengaged from the rotary latch 5. The safety catch 8 is thereby pivotal with the aid of the connecting element 13 on the drive element 11, mounted such that it is radially offset to its rotational axle 12. As soon as the safety catch 8 is in the released position, the rotary latch 5 can move toward the open position, or respectively, rotate thereto. Preferably, the safety catch 8 is preloaded toward the engaged position, which can occur, for example, by means of a spring element 24, which is only shown by way of example in FIG. 3, wherein it is sufficient if the region of the locking section 9 of the safety catch 8 is pushed by means of the spring force to the engaged position, and thereby toward the rotary latch 5, or respectively, the locking arm 10 of the rotary latch 5.

Figure 5:
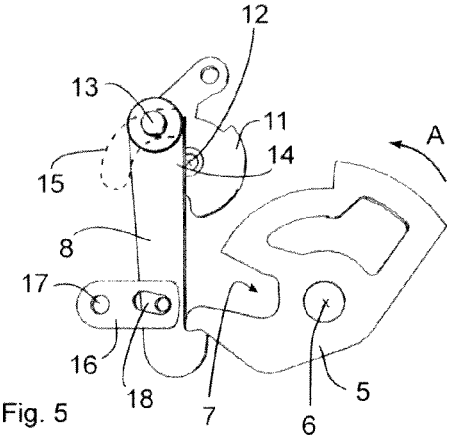
FIG. 5: the motor vehicle door latch according to the first embodiment in an intermediate position between the closed and an open position.

In order to prevent an acoustically audible and disturbing opening sound of the hatchback, subjected to a preloading, and thereby the motor vehicle door latch, it is provided according to the invention, that the drive element 11 moves the safety catch 8 during the movement from the engaged position toward the released position in such a manner that the rotary latch 5, which is still engaged with the safety catch 8 during this movement, is moved toward the open position. The preloading of the hatchback is reduced by means of this movement, because the hatchback can move from the closed position about a defined lift, due to the described dynamic coupling. This procedure is depicted in FIGS. 4-7, wherein FIG. 4 shows the closed position, FIG. 7 shows the released position of the safety catch 8, and FIGS. 5 and 6 show intermediate positions of the rotary latch 5 and the safety catch 8.

In the following, the procedures during the opening of the motor vehicle door latch, which are the primary concern of the invention, shall be explained in greater detail.

A movement curve 15 of the connecting element 13, or respectively, the coupling section 14, which is connected by means of the connecting element 13 to the drive element, is shown by a broken line in FIGS. 4-7. The movement curve 15 corresponds substantially to the control holes 22*a* and 22*b* formed in the housing elements 3 and 4. It can be seen that based on the movement curve 15, the movement of the coupling section 14 of the safety catch 8, pivotally attached to the connecting element 13, from the engaged position toward the released position, is a movement shaped as a circular arc section, which occurs in FIGS. 4-7 in the counterclockwise direction, along arrow A. Accordingly, a rotational, or respectively, rotary movement of the drive element 11 results in the coupling section 14 of the safety catch 8 moving along a circular arc section. The control holes 22*a* and 22*b* formed in the housing elements 3 and 4 can also guide the movement of the connecting element 13. The control holes 22*a* and 22*b* are, however, unnecessary, and as such, may be left out of the motor vehicle door latch according to the invention.

In a closer examination of the FIGS. 4-7 it can be seen that the rotary movement, or respectively, rotational movement of the drive element 11 in the counterclockwise direction first causes a substantially tangential movement of the locking section 9 of the safety catch 8 with respect to the rotary catch 5. Although the coupling section 14 of the safety catch moves along the movement curve 15, shaped as a circular arc section, the locking section 9 of the safety catch 8 first moves in a direction substantially tangential to the rotary latch 5. In other words, the safety catch 8 moves downward in relation to the rotary latch 5, in a first step from FIG. 4 to FIG. 5, by means of which it is possible for the rotary latch 5 to rotate in the direction of the arrow A, by means of which, on the whole, the preloading acting on the hatchback is reduced. With the movement of the safety latch 8 from the position shown in FIG. 5, to the position depicted in FIG. 6, both a tangential movement of the locking section 9 of the safety catch 8 results in relation to the rotary latch 5, as well as a radial movement of the locking section 9 of the safety catch 8 away from the rotary latch 5, from which it can be seen that the locking section 9 is pushed to a certain degree away from the locking arm 10 of the rotary latch 5. In a subsequent step, the movement of the safety catch 8 toward the released position, i.e. from the position in FIG. 6 to the position in FIG. 7, the rotational movement of the drive element 11 then causes a substantially radial movement of the locking section 9 of the safety catch 8, away from the rotary latch 5, in order to disengage the safety catch 8 and the rotary latch 5, as is shown, finally, in FIG. 7. In this position, in which the rotary latch 5 is in the open position, and the safety catch 8 is in the released position, the locking arm 10 and the locking section 9 become disengaged, and can move past each other, whereby the rotary latch 5 continues to rotate in the direction of the arrow A, in order that the locking element 2 is disengaged from the rotary catch jaw 7. In this manner, the safety catch 8 and the rotary latch 5 are disengaged for the opening of the hatchback, in that the safety catch 8 is pivoted at least to some degree away from the rotary latch 8. In doing so, as mentioned above, the safety catch 8 is moved by the drive element 11 during the movement away from the engaged position toward the released position in such a manner that the rotary latch 5, which is still engaged with the safety catch 8 during this movement, is moved toward the open position. The drive element 11 is rotated for the opening of the motor vehicle door latch 1 in such a manner that the safety catch 8, or at least a section of the safety catch 8 is first moved during the movement from the engaged position toward the released position in a substantially tangential direction in relation to the rotary latch 5, and then, in order to disengage the safety catch 8 and the rotary latch 5, is moved away from the rotary latch 5 in a substantially radial direction.

With the entire movement of the safety catch 8, as described above, the movement of the coupling section 14, which follows the circular arc section shaped movement curve 15 due to the dynamic coupling with the drive element 11, deviates from the movement of the locking section 9 of the safety catch 8. The locking section 9, which is engaged with the rotary latch 5 in the engaged position, is guided in its movement by means of a guide element 16. The guide element 16 is disposed on the housing element 3 of the motor vehicle door latch, and pivotally mounted on an axle 17 thereon. Moreover, the guide element 16 has a guide hole 18 having two opposing stop surfaces, which lead to, or control, respectively, a movement of the locking section 9 of the safety catch 8 that can be engaged with the rotary latch 5, toward the rotary latch 5, or away from the rotary latch 5. In particular, the movement of a control pin 19 can be guided in the guide hole 18, which is formed in the region of the locking section 9 of the safety catch 8 (see FIGS. 4 and 8). The movement of the guide element 16 itself can be limited by a movement limiting hole 20 (see FIG. 1) formed in the housing element 3. The locking section 9 of the safety catch can, as mentioned above, be preloaded in the direction of the engagement position by means of the spring element 24, such that the control pin 19 formed in the region of the locking section 9 is pushed radially toward the rotary latch 5 at the outermost end of the guide hole 18, formed in the guide element 16, during the movement procedure depicted in FIGS. 4-7.

As an alternative to the guide element 16, a radial movement away from the rotary latch 5 can be caused by said rotary latch itself. For this purpose, an external section of the rotary latch 5 can have a radial projection 21, as is indicated, or respectively, depicted, in FIG. 4 by a broken line. With the rotation of the rotary latch 5, the radial projection 21 is then moved to a position on the safety catch 8, when it has been rotated sufficiently, and the safety catch 8 is then pushed away, or deflected, respectively, in such a manner that the locking section 9 and the locking arm 10 become disengaged.

A position of the motor vehicle door latch 1 during the closing procedure is shown in FIG. 8, in which the coupling section 14 of the safety catch 8 is again in the engaged position, whereby the locking section 9 of the safety catch 8, on the other hand, is disposed such that it is pivoted radially away from the rotary latch 5, wherein the control pin 19 assumes a central position in the guide hole 18 of the guide element 16. Due to the fact that the control pin 19 of the locking section 9 can be pushed against the force of the spring element 24 in the guide hole 18 of the guide element 16 radially away from the rotary latch 5, it is possible for the rotary latch 5 to rotate in the direction of the arrow B during the closing procedure, and with said movement, the locking arm 10 slides past the locking section 9. At this point, the preloading of the safety catch 8 ensures that then, when the locking arm 10 has passed by the locking section 9, the two engage, or respectively, the locking section 9 then pushes over the locking arm 10, and ensures the engagement of the safety catch 8 and the rotary latch 5, such that the closed position depicted in FIG. 4 is again assumed. The closing procedure is not to be examined more closely here, however, because the invention is primarily concerned with the opening procedures of the motor vehicle door latch.

The motor vehicle door latch 1 according to the second embodiment is depicted in FIGS. 9-13. With respect to the FIGS. 9-13 it may be seen that the motor vehicle door latch 1 according to the second embodiment—in the same manner as that with the first embodiment—comprises a housing element 3, which for reasons of simplicity is only depicted in FIG. 9, a rotary latch 5 having a rotary latch jaw 7 rotatably mounted around and on a rotation axle 6, in which the closing element 2 is disposed when in the engaged position, and having a locking arm 10, which is engaged, when in the engaged position, with a locking section 9 of the safety catch 8, and a drive element 11, which can be rotated about a rotational axle 12. In FIG. 9, there is no depiction of the spring elements 23 and 24, although the second embodiment can also have corresponding spring elements 23, 24, in order that the rotary latch 5 can be spring loaded, or respectively, preloaded in the direction of the arrow A (FIGS. 12 and 13), i.e. toward its open position. In addition, the safety catch 8 can also be preloaded or spring loaded toward the engagement position with the aid of such a spring element. This construction and the combined action of the safety catch 8 and the rotary latch 5 is substantially identical to the functionality of these components with the first embodiment, such that a repetition of the description can be dispensed with here, and instead, reference may be made to the corresponding designs of the first embodiment.

With the second embodiment, the safety catch 8 is also connected to the drive element 11 by means of a dynamic coupling. However, there are differences between the first and second embodiment regarding this coupling, which shall be explained in greater detail below in the description of the second embodiment.

Figure 11:
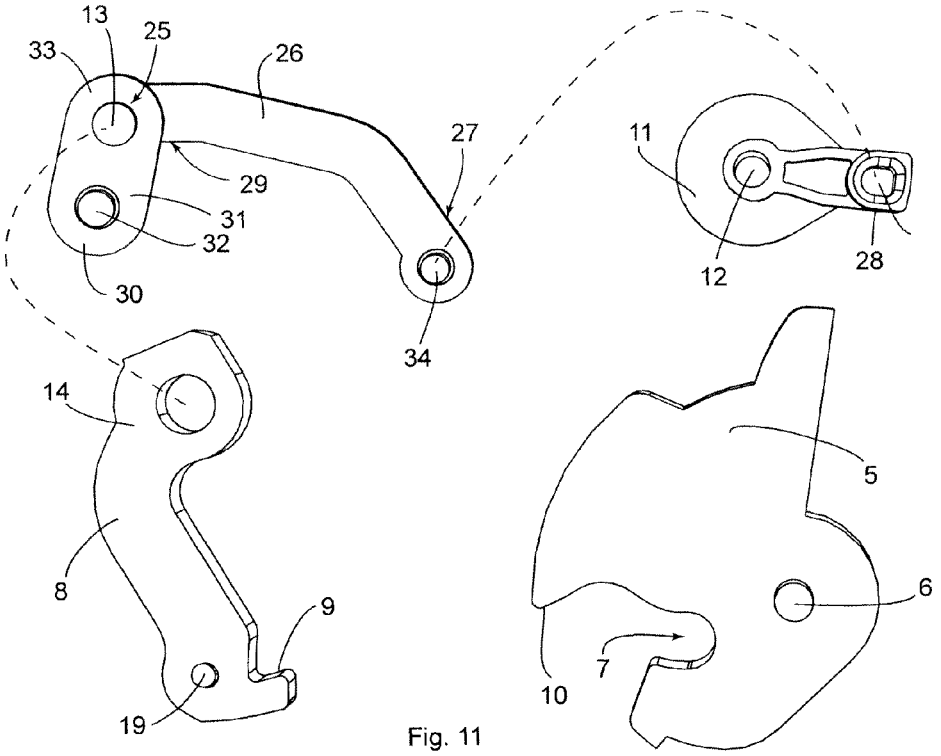
FIG. 11: the motor vehicle door latch from FIG. 10 in an individual parts depiction.
Figure 13:
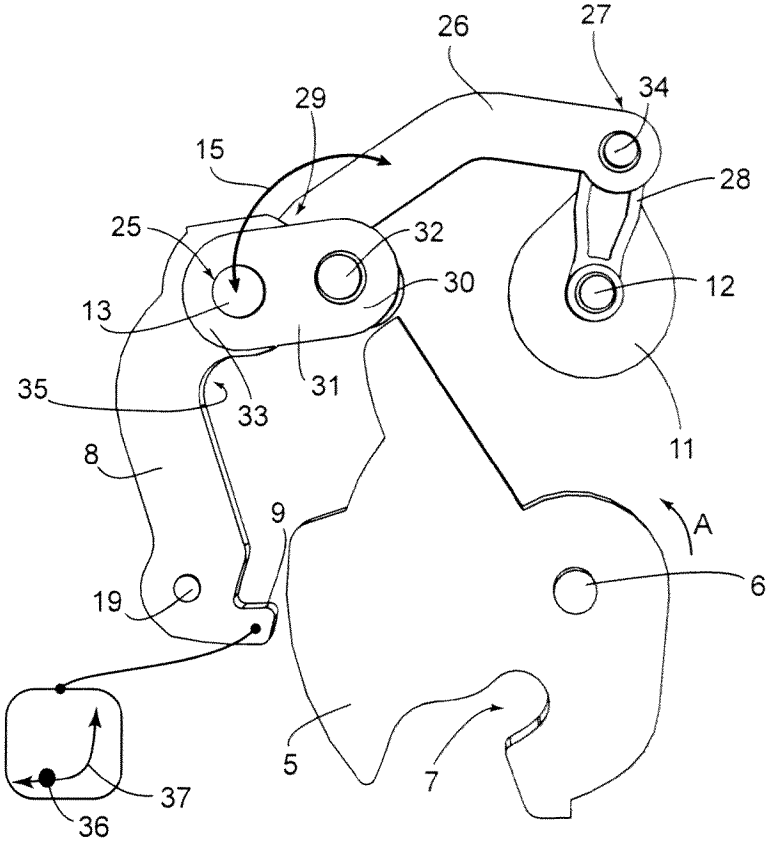
FIG. 13: the motor vehicle door latch from FIG. 10 in a released position, or respectively, the open position.

While the rotary latch 5, with the aid of the fixed location rotational axle 6, is mounted in a rotational manner on the housing element 3, the coupling section 14 of the safety catch 8 is attached to, or respectively, mounted on, the connecting element 13 in a pivotal manner. In so doing, the connecting element defines a joint, or respectively, a pivotal axle 25. The joint, or respectively, pivotal axle 25 is not fixed in terms of its location, in contrast to the rotational axle 6, but instead moves during the movement of the safety catch 8 toward the released position in relation to the rotational axle 6 of the rotary latch 5, in a translational manner along the movement curve 15 shown in FIGS. 12 and 13. The coupling section 14 of the safety catch 8 is subjected to a circular arc section shaped movement through said movement curve 15, which is not a rotational movement, but instead is a translational movement. In this manner, a movement shaped as a circular arc section results for the joint, or respectively, pivotal axle 25 and the coupling section 14, when the safety catch 8 moves from the open position (FIG. 12) to the release position (FIG. 13). The position of the connecting element 13 and the joint, or respectively, pivotal axle 25 with respect to the rotational axle 6 of the rotary latch 5, having a fixed location, is accordingly not uniform, but instead changes during the movement of the safety catch 8 from the open position to the release position. This change to the position of the joint 25 and the coupling section 14 is caused in turn by the drive element 11, wherein, however, with the second embodiment, a push rod 26 is inserted between the drive element 11 and the coupling element, which transfers the drive force of the drive element 11 to the coupling section 14 of the safety catch 8. As can be seen in FIG. 11, for example, a first end 27 of the push rod 26 is coupled to the drive element 11. In doing so, the first end 27 of the push rod 26 is radially offset to the rotational axle 12 by a radial projection 28 of the drive element 11, which is rotationally, or respectively, pivotally attached to said drive element. The push rod 26 is slightly bent, whereby a second end 29 of the push rod 26 accommodates the connecting element 13 that is dynamically coupled to the coupling section 14 of the safety catch 8. For the guidance of the movement of the second end 29 of the push rod 26, or respectively, the coupling section 14 of the safety catch 8, a first end 30 of an articulated lever 31 is rotationally mounted on a guide axle, or respectively, a joint axle 32, attached to the housing element 3. A second end 33 of the articulated lever 31 supports the push rod 26 and the connecting element 13, movably coupled to the safety catch 8, in a rotational and pivotal manner.

The motor vehicle door latch 1 according to the second embodiment is depicted in FIG. 12 in the closed, or respectively, engaged position, while in FIG. 13, the open position of the motor vehicle door latch 1 is shown. The movement of the locking section 9 of the safety catch 8 from the engaged position shown in FIG. 12 to the open position depicted in FIG. 13 occurs along the movement path 36, shown schematically in the box to the side of the motor vehicle door latch 1, wherein the point 37 of the current position (engaged position) of the locking section is indicated on the movement path 36. It should be noted that the coupling section 14 also follows the movement path 36 in a movement from the open position to the engaged position. The push rod 26 is pivoted from the position shown in FIG. 12 to the position shown in FIG. 13 by means of the rotational movement of the drive element 11 (indicated by the arrow C in FIG. 12). In doing so, the movement of the second end 29 of the push rod 26 is guided by the articulated lever 31 along the movement curve 15, such that it moves thereby the connecting element 13 and the coupling section 14 of the safety catch 8, which is coupled to the second end 29 of the push rod 26. The coupling section 14 of the safety catch 8 moves in a path, substantially shaped as a circular arc, as a result of said coupling. The movement of the locking section 9 from the engaged position toward the release position, however, is a substantially tangential movement of the locking section 9 in relation to the rotary latch 5, characterized by the vertical course of the movement path 36. As a result, the safety catch 8 continues to remain engaged with the rotary latch 5. The tangential movement of the locking section 9, however, enables a rotational movement of the rotary latch 5 toward the open position, such that the preloading, present when the latch is closed, is reduced, without the latch being open. This movement sequence corresponds to the sequence shown in FIGS. 4 and 5 of the first embodiment of the motor vehicle door latch 1. In a second movement section of the locking section 9, said locking section is then moved radially away from the rotary latch 5, characterized by the substantially vertical course of the movement path 36, in order to disengage the safety catch 8 and the rotary latch 5. This sequence corresponds to the movement sequence depicted in FIGS. 5 and 6 of the first embodiment of the motor vehicle door latch 1.

The transference of force of the drive element 11 occurs by means of the radial projection 28, corresponding to a transference lever, transferring the force to the push rod 26, from which the force is then further transferred to the coupling section 14 of the safety catch 8. In doing so, the transferred force from articulated lever 31 is converted to a defined movement of the coupling section 14, as described above. With respect to the transference of force the articulated lever 31 defines a first bent lever, and the radial projection 28, 26 defines a second bent lever, forming a particularly powerful dynamic coupling. The second bent lever ensures that the first bent lever, in particular because the torques at the second bent lever are quite small, such that it can be easily secured with a minimum of force. For safety reasons, it is also desirable that the motor vehicle door latch 1 remain in the closed position, even in the event of a vehicle accident. For this reason, the motor vehicle door latch 1 must withstand the acceleration forces prevailing in a vehicle accident, such that the safety catch and the rotary latch do not become disengaged. For this reason, the safety catch 8 exhibits a bend 35 (see FIGS. 10 and 13), which abuts the guide axle 32 acting as an end stop in the engaged position (FIGS. 10 and 12) and restricting the movement of the safety catch 8 beyond the engaged position. In this position, in which the bend 35 of the safety catch 8 abuts the guide axle 26, i.e. in the engaged position, the push rod 26 assumes a position in which a dead point has been exceeded, and as a result is locked in the engaged position in a self-retaining manner. The guide axle 32 serves thereby as a mechanical stop, which restricts the movement of the safety catch 8 out of the open position to the engaged position.

In summary, a motor vehicle door latch 1 is presented, distinguished in that the sound development during the opening procedure is reduced to a minimum, and in particular, the sound from an abrupt release is minimized. This is attained in that during the opening procedure, the safety catch 8 and the rotary latch 5 are moved toward one another such that the hatchback, and thereby the motor vehicle door latch 1, can move in relation to the closing element 2, as a result of which, the pressure applied to the hatchback, or respectively, the preloading of the hatchback is first reduced, before the safety catch 8 and the rotary latch 5 are ultimately disengaged from one another, in order to release the closing element 2. In particular, this is attained in that with the opening procedure, the connecting element 13, which defines a pivotal axle for the safety catch, moves in relation to the rotational axle 6 of the rotary latch 5, as a result of which first the tangential movement of the rotary latch 5 and then the radial movement of the rotary latch 5 in translated to the movement of the locking section 9 of the safety catch 8 defining the movement path.

It is understood as a matter of course, that the invention described above is not limited to the described and illustrated embodiments. It is clear that numerous, for the person skilled in the art, suggested variations to the embodiments depicted in the drawings can be undertaken corresponding to the intended use, without abandoning thereby the field of the invention. For this, all that is contained in the description and/or depicted in the drawings, including that which deviates from the concrete embodiment examples, that is suggested for the person skilled in the art, is the propriety of the invention as recited in the claims appended hereto.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A motor vehicle door latch including a rotary latch, which captures a closing element when in a closed position, and is biased via a biasing element toward an open position, a safety catch, which is engaged with the rotary latch in an engagement position in such a manner that the rotary latch is prevented from moving toward the open position, and a drive element which is rotated via a motor and is dynamically coupled to a coupling section of the safety catch wherein the drive element moves the safety catch between the engagement position and a releasing position, in which the safety catch is not engaged with the rotary latch, such that the rotary latch can move toward the open position, wherein the drive element moves the safety catch during movement away from the engagement position toward the releasing position in such a manner that the rotary latch, which is still engaged with the safety catch during said movement, moves toward the open position;

wherein the rotary latch is pivotally mounted, by means of a rotational axle disposed in a fixed location on a housing element of the motor vehicle door latch and that the coupling section of the safety catch, is pivotally attached to a connecting element such that it can pivot around said connecting element, wherein the connecting element defines a joint for the safety catch, wherein the joint moves in a translational manner during the movement of the safety catch toward the releasing position in relation to the rotational axle of the rotary latch.

2. The motor vehicle door latch according to claim 1, wherein the movement of the drive element is a rotational movement, which causes a substantially tangential movement of the safety catch in relation to the rotary latch during the movement of the safety catch from the engagement position toward the releasing position, and then, in order to disengage the safety catch and the rotary latch, causes a substantially radial movement of the safety catch away from the rotary latch.

3. The motor vehicle door latch according to claim 1, wherein the rotary latch is pivotally mounted, by means of a rotational axle disposed in a fixed location on a housing element of the motor vehicle door latch and that the coupling section of the safety catch, which is dynamically coupled to the drive element, is pivotally attached to a connecting element such that it can pivot around said connecting element.

4. The motor vehicle door latch according to claim 1, wherein the drive element is mounted on a housing element of the motor vehicle door latch in such a manner that it can rotate about a rotational axle.

5. The motor vehicle door latch according to claim 1, wherein the connecting element is disposed on the drive element, radially offset to the rotational axle.

6. The motor vehicle door latch according to claim 1, wherein a locking section of the safety catch, which is engaged with the rotary latch in the engagement position, is guided in terms of its movement by means of a guide element and/or a control pin attached to the safety catch.

7. The motor vehicle door latch according to claim 6, wherein the guide element is pivotally disposed on a housing element of the motor vehicle door latch, and exhibits a guide recess, which guides a movement of the locking section of the safety catch, which can be engaged with the rotary latch, to the rotary latch or away from the rotary latch.

8. The motor vehicle door latch according to claim 1, wherein the safety catch is biased toward the engagement position.

9. The motor vehicle door latch according to claim 1, wherein the rotary latch is pivotally mounted, by means of a rotational axle disposed in a fixed location on a housing element of the motor vehicle door latch or that the coupling section of the safety catch, which is dynamically coupled to the drive element, is pivotally attached to a connecting element such that it can pivot around said connecting element.

10. A motor vehicle door latch including a rotary latch, which captures a closing element when in a closed position, and is biased via a biasing element toward an open position, a safety catch, which is engaged with the rotary latch in an engagement position in such a manner that the rotary latch is prevented from moving toward the open position, and a drive element rotated via one of a motor and manual means and dynamically coupled to a coupling section of the safety catch wherein the drive element moves the safety catch between the engagement position and a releasing position, in which the safety catch is not engaged with the rotary latch, such that the rotary latch can move toward the open position, wherein the drive element moves the safety catch during movement away from the engagement position toward the releasing position in such a manner that the rotary latch, which is still engaged with the safety catch during said movement, moves toward the open position, wherein the rotary latch is pivotally mounted, by means of a rotational axle disposed in a fixed location on a housing element of the motor vehicle door latch and that the coupling section of the safety catch, is pivotally attached to a connecting element such that it can pivot around said connecting element; and, a push rod which has a first end coupled pivotally to the drive element, and radially offset to a rotational axle of the drive element, and a second end of which accommodates the connecting element, which is dynamically coupled to the coupling section of the safety catch, wherein a first end of an articulated lever is rotatably mounted at a fixed location on a guide axle attached to a housing element, and a second end of the articulated lever rotatably and pivotally supports the push rod and the connecting element, which is dynamically coupled to the safety catch.

11. The motor vehicle door latch according to claim 10, wherein the safety catch exhibits a bend, which abuts the guide axle, which acts in the engaged position as an end stop on said guide axle, and restricts the movement of the safety catch beyond the engagement position.

12. The motor vehicle door latch according to claim 11, wherein the movement of the coupling section of the safety catch, attached in a pivotal manner to the connecting element, from the engaged position toward the releasing position is a movement in the shape of a circular arc section.

* * * * *